US006989223B2

(12) United States Patent
Dickerson et al.

(10) Patent No.: US 6,989,223 B2
(45) **Date of Patent: *Jan. 24, 2006**

(54) HIGH-SPEED RADIOGRAPHIC FILM

(75) Inventors: Robert E. Dickerson, Hamlin, NY (US); Robert D. Wilson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/958,737

(22) Filed: Oct. 5, 2004

(65) Prior Publication Data

US 2005/0100839 A1 May 12, 2005

Related U.S. Application Data

(63) Continuation-in-part of application No. 10/706,667, filed on Nov. 12, 2003, now abandoned.

(51) Int. Cl.
*G03C 1/035* (2006.01)
*G03C 1/46* (2006.01)
*G03C 5/17* (2006.01)

(52) U.S. Cl. ..... 430/139; 430/502; 430/509; 430/966

(58) Field of Classification Search ..... 430/502, 430/509, 139, 966
See application file for complete search history.

(56) References Cited

U.S. PATENT DOCUMENTS

| | | | | |
|---|---|---|---|---|
| 4,414,304 | A | 11/1983 | Dickerson | |
| 4,414,310 | A | 11/1983 | Daubendiek et al. | |
| 4,425,425 | A | 1/1984 | Abbott et al. | |
| 4,425,426 | A | 1/1984 | Abbott et al. | |
| 4,713,320 | A | 12/1987 | Maskasky | |
| 4,803,150 | A | 2/1989 | Dickerson et al. | |
| 4,900,652 | A | 2/1990 | Dickerson et al. | |
| 5,252,442 | A | 10/1993 | Dickerson et al. | |
| 5,268,251 | A | 12/1993 | Sakuma | |
| 5,430,302 | A | 7/1995 | Torardi | |
| 5,432,351 | A | 7/1995 | Pesce et al. | |
| 5,461,660 | A | 10/1995 | Dooms et al. | |
| 5,746,943 | A | 5/1998 | Torardi | |
| 5,888,647 | A | 3/1999 | Yamane | |
| 5,998,083 | A | 12/1999 | Verbeeck et al. | |
| 6,190,822 | B1 * | 2/2001 | Dickerson et al. | 430/139 |
| 6,350,554 | B1 * | 2/2002 | Dickerson et al. | 430/139 |
| 6,361,918 | B1 * | 3/2002 | Dickerson et al. | 430/139 |
| 6,387,586 | B1 * | 5/2002 | Dickerson et al. | 430/139 |
| 6,394,650 | B1 | 5/2002 | Ohara et al. | |
| 6,472,137 | B1 | 10/2002 | Verbeeck et al. | |
| 6,682,868 | B1 * | 1/2004 | Dickerson et al. | 430/139 |
| 6,686,115 | B1 | 2/2004 | Dickerson et al. | |
| 6,686,116 | B1 | 2/2004 | Dickerson et al. | |
| 6,686,117 | B1 | 2/2004 | Davis et al. | |
| 6,686,118 | B1 | 2/2004 | Davis et al. | |
| 6,686,119 | B1 | 2/2004 | Pavlik et al. | |
| 2001/0031418 | A1 | 10/2001 | Taguchi | |
| 2003/0138722 | A1 | 7/2003 | Taguchi | |

FOREIGN PATENT DOCUMENTS

| | | |
|---|---|---|
| EP | 0 660 173 A2 | 6/1995 |
| EP | 0 678 772 A1 | 10/1995 |
| EP | 0 690 342 B1 | 1/1996 |
| EP | 0 581 065 B1 | 10/1999 |
| EP | 1 178 353 A1 | 2/2002 |

OTHER PUBLICATIONS

"Improvement in the Image Quality of Cerebral Angiograms" by Rossman et al, *Radiology*, vol. 96, pp. 361-365, Aug., 1970.
"Comparison of High-MTF and Reduced-noise Radiograhic Imaging Systems" by Phillip C. Bunch, SPIE vol. 2432, May 1995.
JP Abstract 2001-613463/71.
JP Abstract 2002-413377/44.
JP Abstract 2004-223747/21.
U.S. Appl. No. 10/706,340 (D-84504) filed Nov. 12, 2003, by Dickerson et al., titled *Ultra-High-Speed Radiographic Film, Imaging Assembly, And Method.*
U.S. Appl. No. 10/958,736 (D-84504A) filed herewith, by Dickerson et al., titled *High-Speed Radiographic Imaging Assembly.*
U.S. Appl. No. 10/706,010 (D-84505) filed Nov. 12, 2003, by Dickerson et al., titled *Ultra-High Speed Radiographic film, Imaging Assembly, And Method To Provide Sharp Images.*
U.S. Appl. No. 10/706,667 (D-84506) filed Nov. 12, 2003, by Dickerson et al., titled *High Speed General Purpose Radiographic Film To Provide Sharp Images.*
U.S. Appl. No. 10/706,655 (D-84507) filed Nov. 12, 2003, by Dickerson et al., titled *High Speed Imaging Assembly For General-Purpose Radiography.*
U.S. Appl. No. 10/712,389 (D-84508) filed Nov. 12, 2003, by Dickerson et al., titled *High Speed Imaging Assembly For General-Purpsose Radiography.*

(Continued)

*Primary Examiner*—Richard L. Schilling
(74) *Attorney, Agent, or Firm*—J. Lanny Tucker

(57) ABSTRACT

A high-speed (over 700) radiographic silver halide film is useful for radiography to provide images with improved contrast and sharpness and reduced fog. The film includes at least one tabular grain silver halide emulsion layer on each side of a film support which grains are dispersed in a hydrophilic polymeric vehicle mixture comprising at least 0.05% of oxidized gelatin, based on the total dry weight of the hydrophilic polymeric vehicle mixture. Where multiple silver halide emulsion layers are disposed on each side of the film support, the emulsion layers closest to the support on each side can include crossover control agents to reduce crossover to less than 15%.

21 Claims, No Drawings

OTHER PUBLICATIONS

U.S. Appl. No. 10/706,191 (D-84509) filed Nov. 12, 2003, by Dickerson et al., titled *Imaging Assembly For Otrthopedic Radiography*.

U.S. Appl. No. 10/706,529 (D-84276) filed Nov. 12, 2003, by Dickerson et al., titled *Ultrahigh Speed Imaging Assembly For General-Purpose Radiography*.

U.S. Appl. No. 10/958,785 (D-84276A) filed herewith, by Dickerson et al., titled *Ultrahigh Speed Imaging Assembly For Radiography*.

U.S. Appl. No. 10/706,574 (D-84277) filed Nov. 12, 2003, by Dickerson et al., titled *Ultrahigh Speed Imaging Assembly For Orthopedic Radiography*.

U.S. Appl. No. 10/958,738 (D-84277A) filed herewith, by Dickerson et al., titled *High Speed Imaging Assembly For Radiography*.

*Research Disclosure*, Item No. 22534, Jan. 1983, titled "Sensitized high aspect ration silver halide emulsions and photographic elements".

* cited by examiner

HIGH-SPEED RADIOGRAPHIC FILM

RELATED APPLICATION

This is a Continuation-in-part application of commonly assigned and U.S. Ser. No. 10/706,667 filed Nov. 12, 2003 Now Abandoned.

FIELD OF THE INVENTION

This invention is directed to radiography. In particular, it is directed to a radiographic silver halide film having a speed of at least 700 that provides improved medical diagnostic images.

BACKGROUND OF THE INVENTION

In conventional medical diagnostic imaging, the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the duplitized radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.), U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and U.S. Pat. No. 5,576,156 (Dickerson), and *Research Disclosure*, Vol. 184, August 1979, Item 18431.

Problem to be Solved

Image quality and radiation dosage are two important features of film-screen radiographic combinations (or imaging assemblies). High image quality (that is, high resolution or sharpness) is of course desired, but there is also the desire to minimize exposure of patients to radiation. Thus, "high speed" radiographic films are needed. However, in known radiographic films, the two features generally go in opposite directions. Thus, films that can be used with low radiation dosages (that is, "high speed" assemblies) generally provide images with poorer image quality (poorer resolution). Lower speed imaging assemblies generally require higher radiation dosages.

There is a need for films for general-purpose radiography that require minimum radiation dosages with minimal sacrifice in image quality (such as resolution or sharpness).

SUMMARY OF THE INVENTION

In general, this invention provides a radiographic silver halide film having a film speed of at least 700, and comprising a support that has first and second major surfaces, the radiographic silver halide film having disposed on the first major support surface, one or more hydrophilic colloid layers including at least one silver halide emulsion layer, and,having on the second major support surface, one or more hydrophilic colloid layers including at least one silver halide emulsion layer, each of the silver halide emulsion layers comprising tabular silver halide grains that have the same or different composition.

In preferred embodiments, this invention provides a symmetric radiographic silver halide film having a film speed of at least 700, and comprising a support that has first and second major surfaces, the radiographic silver halide film having disposed on the first major support surface, two or more hydrophilic colloid layers including first and second silver halide emulsion layers, and having on the second major support surface, two or more hydrophilic colloid layers including third and fourth silver halide emulsion layers, the first and third silver halide emulsion layers being the outermost emulsion layers on their respective sides of the support, each of the first, second, third, and fourth silver halide emulsion layers comprising tabular silver halide grains that have the same or different composition, an aspect ratio of at least 15, and an average grain diameter of at least 3.0 $\mu$m and comprise at least 50 mol % bromide and up to 5 mol % iodide, both based on total silver in the grains, the second and fourth silver halide emulsion layers comprising a crossover control agent sufficient to reduce crossover to less than 15%, wherein the tabular silver halide grains in the second and fourth silver halide emulsion layers are dispersed in a hydrophilic polymeric vehicle mixture comprising at least 0.05% of oxidized gelatin, based on the total dry weight of the hydrophilic polymeric vehicle mixture.

In more preferred embodiments, this invention provides a symmetric radiographic silver halide film having a film speed of at least 750, and comprising a support that has first and second major surfaces, the radiographic silver halide film having disposed on the first major support surface, two or more hydrophilic colloid layers including first and second silver halide emulsion layers, and having on the second major support surface, two or more hydrophilic colloid layers including third and fourth silver halide emulsion layers, the first and third silver halide emulsion layers being the outermost emulsion layers on their respective sides of the support, each of the first, second, third, and fourth silver halide emulsion layers independently comprising tabular silver halide grains that have the same composition, an aspect ratio of from about 38 to about 45, an average grain diameter of at least 3.5 $\mu$m, an average thickness of from about 0.08 to about 0.14 $\mu$m, and comprise at least 95 mol % bromide and up to 1 mol % iodide, both based on total silver in the grains, each of the second and fourth silver halide emulsion layers comprising a particulate oxonol dye as a crossover control agent present in an amount of from about 1 to about 1.3 mg/dm$^2$ that is sufficient to reduce crossover to less than 12% and is decolorized during development within 90 seconds, the film further comprising a protective overcoat on both sides of said support disposed over all of the hydrophilic colloid layers, wherein the tabular silver halide grains in the second and fourth silver halide emulsion layers are dispersed in a hydrophilic polymeric vehicle mixture comprising from about 5 to about 15% of deionized oxidized gelatin, based on the total dry weight of the hydrophilic polymeric vehicle mixture, wherein the dry, unprocessed thickness ratio of the first silver halide emulsion layer to that of the second silver halide emulsion layer is from about 3:1 to about 1:1, and the dry, unprocessed thickness ratio of the third silver halide emulsion layer to that of the fourth silver halide emulsion layer is independently from about 3:1 to about 1:1, and wherein the molar ratio of silver in the first silver halide emulsion layer to that of the second silver halide emulsion layer is from about 1.5:1 to about 3:1, and the molar ratio of silver in the third silver halide emulsion layer to that of the fourth silver halide emulsion layer is independently from about 1.5:1 to about 3:1.

This invention also provides a radiographic imaging assembly comprising a radiographic silver halide film of this invention that is arranged in association with one or more fluorescent intensifying screens. In preferred embodiments, the radiographic silver halide films are arranged in association with two fluorescent intensifying screens, one on either side thereof.

In addition, a method of providing a black-and-white image comprises exposing a radiographic silver halide film of the present invention and processing it, sequentially, with a black-and-white developing composition and a fixing composition. The resulting images are preferably used for a medical diagnosis. The film can be imaged within the imaging assembly of this invention or outside of it.

The present invention provides a film particularly useful for providing radiographic images having improved image quality (resolution or sharpness) with reduced imaging X-radiation dosage.

In addition, the radiographic films have higher $D_{max}$, increased speed (at least 700) and contrast, and decreased $D_{min}$ (fog). In addition, the radiographic films can be rapidly processed in conventional processing equipment and compositions.

In preferred embodiments, these advantages are achieved by having a unique set of two silver halide emulsion layers on both sides of the film support comprising tabular silver halide grains having specific halide compositions and aspect ratios. In addition, the silver halide emulsion layers closest to the support on both sides preferably comprise crossover control agents and their tabular grains are dispersed in a polymeric binder mixture that includes at least 0.05 weight % of oxidized gelatin (based on total dry weight of the polymeric binder mixture in the silver halide emulsion layer).

DETAILED DESCRIPTION OF THE INVENTION

Definition of Terms:

Unless otherwise indicated, the term "radiographic silver halide film" refers to an embodiment of the present invention.

The term "contrast" as herein employed refers toe average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta$ $\log_{10}E$ ($\log_{10}E_2-\log_{10}E_1$), $E_1$ and $E_2$ being the exposure levels at the reference points (1) and (2).

"Gamma" is used to refer to the instantaneous rate of change of a density vs. log E sensitometric curve (or the instantaneous contrast at any log E value).

In this application, "film speed" has been given a standard of "400" for Radiographic Film A described in Example 1 below, that has been exposed for approximately 0.15 second and processed according to conditions shown in Example 1, using a pair of fluorescent intensifying screens containing a terbium activated gadolinium oxysulfide phosphor (such as Screen X noted below in Example 3). Thus, if the $K_s$ value for a given system using a given radiographic film is 50% of that for a second film with the same screen and exposure and processing conditions, the first film is considered to have a speed 200% greater than that of the second film.

The term "duplitized" is used to define a radiographic film having silver halide emulsion layers disposed on both the front- and backsides of the support. The radiographic silver halide films of the present invention are "duplitized."

The preferred radiographic silver halide films of the present invention are "symmetric" films wherein the sensitometric responses and properties are essentially the same on both sides of the support. However, this does not necessarily mean that the silver halide emulsion layers on opposing sides of the support are compositionally the same. In more preferred embodiments, the films have essentially the same imaging and non-imaging layers on opposing sides of he support to provide essentially the same sensitomethic response and properties.

"Asymmetric" radiographic silver halide films are films having different sensitometric responses from the layer(s) on both sides of the support. In most instances, this means that one or more of the silver halide emulsion layers are different on opposing sides of the support.

"Crossover" refers to radiation that images and passes through the emulsion layer(s) on one side of the support and images the emulsion layers on the opposite side of the support. Measurements for crossover are determined by determining the density of the silver developed on a given side of the support. Densities can be determined using a standard densitometer. By plotting the density produced on each imaging side of the support versus the steps of a conventional step wedge (a measure of exposure), a characteristic sensitometric curve is generated for each imaging side of the material. At three different density levels in the relatively straight-line portions of the sensitometric curves between the toe and shoulder regions of the curves, the difference in speed ($\Delta$ log E) between the two sensitometric curves is measured. For "asymmetric" radiographic silver halide films, those curves will not likely be parallel so a skilled artisan would need to choose three different density levels along the curves that would be reasonable under those circumstances. In all cases, the three density differences are then averaged and used in the following equation to calculate the % crossover:

$$\%\ \text{Crossover} = \frac{1}{\text{antilog}(\Delta \log E) + 1} \times 100$$

In referring to grains and silver halide emulsions containing two or more halides, the halides are named in order of ascending molar concentrations.

The term "equivalent circular diameter" (ECD) is used to define the diameter of a circle having the same projected area as a silver halide grain. This can be measured using known techniques.

The term "aspect ratio" is used to define the ratio of grain ECD to grain thickness.

The term "coefficient of variation" (COV) is defined as 100 times the standard deviation (a) of grain ECD divided by the mean grain ECD.

The term "fluorescent intensifying screen" refers to a screen that absorbs X-radiation and emits light. A "prompt" emitting fluorescent intensifying screen will emit light immediately upon exposure to radiation while "storage" fluorescent screen can "store" the exposing X-radiation for emission at a later time when the screen is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. The publication is also available from Emsworth Design Inc., 147 West 24th Street, New York, N.Y 10011.

Radiographic Films

The radiographic silver halide films have a speed of at least 700 and preferably of at least 750 and include a support having disposed on both sides thereof, one or more (preferably two) photographic silver halide emulsion (hydrophilic colloid) layers and optionally one or more non-light sensitive hydrophilic colloid layer(s). In preferred embodiments, "first" and "second" silver halide emulsion layers are disposed on the frontside of the support and "third" and "fourth" silver halide emulsion layers are disposed on the backside of the support, with the second and fourth silver halide emulsion layers being closer to the support (innermost silver halide emulsion layers) than the first and third silver halide emulsion layers (outermost silver halide emulsion layers).

In the more preferred embodiments, the two silver halide emulsion layers on each side of the support are essentially the same in chemical composition (for example, components, types of grains, silver halide composition, hydrophilic colloid binder composition, and g/m$^2$ coverage), and sensitometric properties but (as noted below) are different in thickness and hence silver and hydrophilic binder coverage. In such embodiments, the first and second silver halide emulsion layers are different in thickness and the third and fourth silver halide emulsion layers are different in thickness. More preferably, all of the silver halide emulsion layers have essentially the same chemical composition.

The support can take the form of any conventional radiographic support that is X-radiation and light transmissive. Useful supports for the films of this invention can be chosen from among those described in *Research Disclosure*, September 1996, Item 38957 (Section XV Supports) and *Research Disclosure*, Vol. 184, August 1979, Item 18431 (Section XII Film Supports). The support is preferably a transparent flexible support. In its simplest possible form the transparent support consists of a transparent film chosen to allow direct adhesion of the hydrophilic silver halide emulsion layers or other hydrophilic layers. More commonly, the transparent support is itself hydrophobic and subbing layers are coated on the film to facilitate adhesion of the hydrophilic silver halide emulsion layers. Typically the support is either colorless or blue tinted (tinting dye being present in one or both of the support and the subbing layers). Polyethylene terephthalate and polyethylene naphthalate are the preferred transparent support materials.

In the preferred embodiments, at least one non-light sensitive hydrophilic layer is included with the one or more silver halide emulsion layers on each side of the support. This layer may be an interlayer or overcoat, or both types of non-light sensitive layers can be present.

The silver halide emulsion layers (for example, the first, second, third, and fourth silver halide emulsion layers) comprise predominantly (more than 50%, and preferably at least 70%, of the total grain projected area) tabular silver halide grains. The grain composition can vary among the layers, but preferably, the grain composition is essentially the same in the first, second, third, and fourth silver halide emulsion layers. These tabular silver halide grains generally comprise at least 50, preferably at least 90, and more preferably at least 95, mol % bromide, based on total silver in the emulsion layer. Such emulsions include silver halide grains composed of, for example, silver iodobromide, silver chlorobromide, silver iodochlorobromide, and silver chloroiodobromide. The iodide grain content is generally up to 5 mol %, based on total silver in the emulsion layer. Preferably the iodide grain content is up to 3 mol %, and more preferably up to about 1 mol % (based on total silver in the emulsion layer). Mixtures of different tabular silver halide grains can be used in any of the silver halide emulsion layers.

Any of the silver halide emulsion layers can also include some non-tabular silver halide grains having any desirable non-tabular or be comprised of a mixture of two or more of such morphologies. The composition and methods of making such silver halide grains are well known in the art.

While the tabular silver halide grains can have any suitable aspect ratio, those used particularly in the first, second third, and fourth silver halide emulsion layers generally and independently have as aspect ratio of 15 or more, preferably from about 25 to about 45, and more preferably, from about 38 to about 45.

In general, the tabular grains in any of the silver halide emulsion layers independently have an average grain diameter (ECD) of at least 3.0 $\mu$m, and preferably of at least 3.5 $\mu$m. The average grain diameters can be the same or different in the various emulsion layers. At least 100 non-overlapping tabular grains are measured to obtain the "average" ECD.

In addition, the tabular grains (especially in the first, second, third, and fourth silver halide emulsion layers) generally and independently have an average thickness of from about 0.06 to about 0.16 $\mu$m, preferably from about 0.08 to about 0.14 $\mu$m, and more preferably from about 0.09 to about 0.11 $\mu$m.

The procedures and equipment used to determine tabular grain size (and aspect ratio) are well known in the art. Tabular grain emulsions can be prepared using the teaching in the following U.S. patents, the disclosures of which are incorporated herein by reference in relation o the tabular grains:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

The total dry unprocessed thickness and coating weight of the silver halide emulsion layers on opposing sides of the support can be the same or different but preferably, they are the same. Where there are two silver halide emulsion layers on each side of the support, they have different dry thickness wherein the outermost silver halide emulsion layers are thicker than the silver halide emulsion layers closer to the support. These evaluations are made on the dried film before it is contacted with processing solutions. Thus, the dry, unprocessed thickness ratio of the first silver halide emulsion layer to that of the second silver halide emulsion layer is greater than 1:1 (preferably from about 3:1 to about 1:1), and the dry, unprocessed thickness ratio of the third silver halide emulsion layer to that of the fourth silver halide emulsion layer is independently greater than 1:1 (preferably from about 3:1 to about 1:1). This generally means that the molar ratios of silver in the first to second, and third to fourth, silver halide emulsion layers, are independently, greater than 1:1 (preferably from about 1.5:1 to about 3:1).

In addition, the silver halide emulsion layers closer to the support on both sides (that is the second and fourth silver halide emulsion layers) generally comprise one or more "crossover control agents" that are present in sufficient amounts to reduce light transmitted through the support to opposing layers to less than 15%, preferably less than 12%, and more preferably less than 10%. Crossover can be measured in the practice of this invention as noted above.

Useful crossover control agents are well known in the art and include one or more compounds that provide a total density of at least 0.3 (preferably at least 0.45) and up to 0.9 at a preferred wavelength of 545 nm and that are disposed on a transparent support. The density can be measured using a standard densitometer (using "visual status"). In general, the amount of crossover control agent in the "second" silver halide emulsion layer will vary depending upon the strength of absorption of the given compound(s), but for most pigments and dyes, the amount is generally from about 0.75 to about 1.5 mg/dm$^2$ (preferably from about 1 mg to about 1.3 mg/dm$^2$).

In addition, the crossover control agents must be substantially removed within 90 seconds (preferably with 45 seconds) during processing (generally during development). By "substantially" means that the crossover control agent remaining in the film after processing provides no more than 0.05 optical density as measured using a conventional sensitometer. Removal of the crossover control agents can be achieved by their migration out of the film, but preferably, they are not physically removed but are decolorized during processing.

Pigments and dyes that can be used as crossover control agents include various water-soluble, liquid crystalline, or particulate magenta or yellow filter dyes or pigments including those described for example in U.S. Pat. No. 4,803,150 (Dickerson et al.), U.S. Pat. No. 5,213,956 (Diehl et al.), U.S. Pat. No. 5,399,690 (Diehl et al.), U.S. Pat. No. 5,922,523 (Helber et al.), and U.S. Pat. No. 6,214,499 (Helber et al.), and Japanese Kokai 2-123349, all of which are incorporated herein by reference for pigments and dyes useful in the practice of this invention. One useful class of particulate dyes useful as crossover control agents includes nonionic polymethine dyes such as merocyanine, oxonol, hemioxonol, styryl, and arylidene dyes as described in U.S. Pat. No. 4,803,150 (noted above) that is incorporated herein for the definitions of those dyes. The particulate merocyanine and oxonol dyes are preferred and the particulate magenta oxonol dyes are most preferred.

One particularly useful magenta oxonol dye that can be used as a crossover control agent is the following compound M-1:

M-1

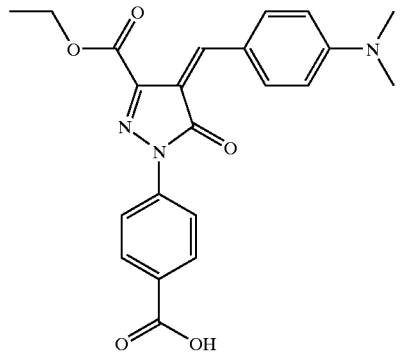

A variety of silver halide dopants can be used, individually and in combination, in one or more of the silver halide emulsion layers to improve contrast as well as other common sensitometric properties. A summary of conventional dopants is provided by *Research Disclosure*, Item 38957 [Section I Emulsion grains and their preparation, sub-section D) and grain modifying conditions and adjustments are in paragraphs (3), (4), and (5)].

A general summary of silver halide emulsions and their preparation is provided in *Research Disclosure*, Item 38957 (Section I Emulsion grains and their preparation). After precipitation and before chemical sensitization the emulsions can be washed by any convenient conventional technique using techniques disclosed in *Research Disclosure*, Item 38957 (Section III Emulsion washing).

Any of the emulsions can be chemically sensitized by any convenient conventional technique as illustrated in *Research Disclosure*, Item 38957 (Section IV Chemical Sensitization). Sulfur, selenium or gold sensitization (or any combination thereof) is specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

In addition, if desired, any of the silver halide emulsions can include one or more suitable spectral sensitizing dyes that include, for example, cyanine and merocyanine spectral sensitizing dyes. The useful amounts of such dyes are well known in the art but are generally within the range of from about 200 to about 1000 mg/mole of silver in the given emulsion layer. It is preferred that all of the tabular silver halide grains used in the present invention (in all silver halide emulsion layers) be "green-sensitized", that is spectrally sensitized to radiation of from about 470 to about 570 nm of the electromagnetic spectrum. Various spectral sensitizing dyes are known for achieving this property.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated in *Research Disclosure*, Item 38957 (Section VII Antifoggants and stabilizers) and Item 18431 (Section II Emulsion Stabilizers, Antifoggants and Antikinking Agents).

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or =S moiety. Such compounds are described in U.S. Pat. No. 5,800,976 (Dickerson et al.) that is incorporated herein by reference for the teaching of such sulfur-containing covering power enhancing compounds.

The silver halide emulsion layers and other hydrophilic layers on both sides of the support of the radiographic films of this invention generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957 (Section II Vehicles, vehicle extenders, vehicle-like addenda and vehicle related addenda). The emulsions themselves can contain peptizers of the type set out in Section II, paragraph A (Gelatin and hydrophilic colloid peptizers). The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include polyacrylates (including polymethacrylates), polystyrenes, polyacrylamides (including polymethacrylamides), and dextrans as described in U.S. Pat. No. 5,876,913 (Dickerson et al.), incorporated herein by reference.

Thin, high aspect ratio tabular grain silver halide emulsions useful in the present invention will typically be prepared by processes including nucleation and subsequent growth steps. During nucleation, silver and halide salt solutions are combined to precipitate a population of silver halide nuclei in a reaction vessel. Double jet (addition of silver and halide salt solutions simultaneously) and single jet (addition of one salt solution, such as a silver salt solution, to a vessel already containing an excess of the other salt) process are known. During the subsequent growth step, silver and halide salt solutions, and/or preformed fine silver halide grains, are added to the nuclei in the reaction vessel, and the added silver and halide combines with the existing population of grain nuclei to form larger grains. Control of conditions for formation of high aspect ratio tabular grain silver bromide and iodobromide emulsions is known, for example, from U.S. Pat. No. 4,434,226 (Wilgus et al.), U.S. Pat. No. 4,433,048 (Solberg et al.), and U.S. Pat. No. 4,439,520 (Kofron et al.). It is recognized, for example, that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, U.S. Pat. No. 4,434,226 (Kofron et al.) teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. U.S. Pat. No. 4,439,520 (noted above) extends these teachings to the precipitation of high aspect ratio tabular grain silver bromide emulsions. pBr is defined as the negative log of the solution bromide ion concentration. U.S. Pat. No. 4,414,310 (Daubendiek et al.) describes a process for the preparation of high aspect ratio silver bromoiodide emulsions under pBr conditions not exceeding the value of 1.64 during grain nucleation. U.S. Pat. No. 4,713,320 (Maskasky), in the preparation of high aspect ratio silver halide emulsions, teaches that the useful pBr range during nucleation can be extended to a value of 2.4 when the precipitation of the tabular silver bromide or bromoiodide grains occurs in the presence of gelatino-peptizer containing less than 30 micromoles of methionine (for example, oxidized gelatin) per gram. The use of such oxidized gel also enables the preparation of thinner and/or larger diameter grains, and/or more uniform grain populations containing fewer non-tabular grains.

The use of oxidized gelatin as peptizer during nucleation, such as taught by U.S. Pat. No. 4,713,320 (noted above), is particularly preferred for making thin, high aspect ratio tabular grain emulsions for use in the present invention, employing either double or single jet nucleation processes. As gelatin employed as peptizer during nucleation typically will comprise only a fraction of the total gelatin employed in an emulsion, the percentage of oxidized gelatin in the resulting emulsion may be relatively small, that is, at least 0.05% (based on total dry weight of hydrophilic polymer vehicle mixture). However, more gelatin (including oxidized gelatin) is usually added to the formulation at later stages (for example, growth stage) so that the total oxidized gelatin can be greater, and for practical purposes as high as 18% (based on total dry weight of hydrophilic polymer vehicle mixture in the silver halide emulsion layer).

In preferred embodiments, the coated first, second, third, and fourth tabular grain silver halide emulsion layers, on one or both sides of the support, comprise tabular silver halide grains dispersed in a hydrophilic polymeric vehicle mixture independently comprising at least 0.05%, preferably at least 1%, and more preferably at least 5%, of oxidized gelatin based on the total dry weight of hydrophilic polymeric vehicle mixture in that coated silver halide emulsion layer. The upper limit for the oxidized gelatin is not critical but for practical purposes, it is 18%, and preferably up to 15%, based on the total dry weight of the hydrophilic polymer vehicle mixture. Preferably, from about 5 to about 15% (by dry weight) of the total hydrophilic polymer vehicle mixture is oxidized gelatin.

The oxidized gelatin may be in the form of deionized oxidized gelatin but non-deionized oxidized gelatin may be preferred because of the presence of various ions, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 $\mu$mol of methionine, and more preferably from 0 to 1 $\mu$mol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the radiographic films are generally fully hardened using one or more conventional hardeners. Thus, the amount of hardener on each side of the support is generally at least 1% and preferably at least 1.5%, based on the total dry weight of the polymer vehicles on each side of the support.

The levels of silver and polymer vehicle in the radiographic silver halide film can vary in the various silver halide emulsion layers. In general, the total amount of silver on each side of the support is independently at least 10 and no more than 25 mg/dm$^2$ (preferably from about 18 to about 24 mg/dm$^2$). In addition, the total coverage of polymer vehicle on each side of the support is independently at least 20 and no more than 40 mg/dm$^2$ (preferably from bout 30 to about 40 mg/dm$^2$). The amount of silver and polymer vehicle on the two sides of the support in the radiographic silver halide film can be the same or different as long as the sensitometric properties on both sides are the same. These amounts refer to dry weights.

The radiographic silver halide films generally include a surface protective overcoat disposed on each side of the support that typically provides for physical protection of the various layers underneath. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957 (Section IX Coating physical property modifying addenda, A. Coating aids, B. Plasticizers and lubricants, C. Antistats, and D. Matting agents). Interlayers that are typically thin hydrophilic colloid layers can be used to provide a separation between the silver halide emulsion layers and the surface overcoats or between the silver halide emulsion layers. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers.

The various coated layers of radiographic silver halide films can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Imaging Assemblies

The radiographic imaging assemblies of the present invention are composed of one radiographic silver halide film of this invention and one or more fluorescent intensifying screens. Usually, two fluorescent intensifying screen are used, one on the "frontside" and the other on the "backside" of the film. The screens can be the same or different in phosphor, screen speed, or other properties. Preferably, the two screens are the same. Fluorescent intensifying screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens are provided by *Research Disclosure*, Item. 18431 (Section IX X-Ray Screens/Phosphors), and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a suitable binder, and may also include a light scattering material, such as titania.

Any conventional or useful phosphor can be used, singly or in mixtures, in the intensifying screens used in the practice of this invention. For example, useful phosphors are described in numerous references relating to fluorescent intensifying screens, including but not limited to, *Research Disclosure*, Vol. 184, August 1979, Item 18431 (Section IX, X-ray Screens/Phosphors) and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), and U.S. Pat. No. 5,871,892 (Dickerson et al.) and EP 0 491,116A1 (Benzo et al.), the disclosures of all of which are incorporated herein by reference with respect to the phosphors.

The silver halide film of the invention and the fluorescent intensifying screens can be arranged in a suitable "cassette" designed for this purpose and well known in the art.

Imaging and Processing

Exposure and processing of the radiographic silver halide films can be undertaken in any convenient conventional manner. The exposure and processing techniques of U.S. Pat. Nos. 5,021,327 and 5,576,156 (both noted above) are typical for processing radiographic films. Exposing X-radiation is generally directed through a patient and then through a fluorescent intensifying screen arranged against the frontside of the film before it passes through the radiographic silver halide film, and the second fluorescent intensifying screen.

Processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multipart formulations, and in concentrated form or as more diluted working strength solutions.

It is particularly desirable that the radiographic silver halide films of this invention be processed generally within 90 seconds ("dry-to-dry") and preferably for at least 20 seconds and up to 60 seconds ("dry-to-dry"), including the developing, fixing, any washing (or rinsing) steps, and drying. Such processing can be carried out in any suitable processing equipment including but not limited to, a Kodak X-OMAT® RA 480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any photographic film hardeners, such as glutaraldehyde.

Radiographic kits can include an imaging assembly, additional fluorescent intensifying screens and/or metal screens, additional radiographic silver halide films, and/or one or more suitable processing compositions (for example black-and-white developing and fixing compositions).

The following examples are presented for illustration and the invention is not to be interpreted as limited thereby.

EXAMPLE 1

Radiographic Film A (Control):

Radiographic Film A was a duplitized film having the two different silver halide emulsion layers on each side of a blue-tinted 170 μm transparent poly(ethylene terephthalate) film support and an interlayer and overcoat layer over each emulsion layer. The emulsions of Film A were not prepared using oxidized gelatin.

Radiographic Film A had the following layer arrangement:

Overcoat
Interlayer
Emulsion Layer 1
Emulsion Layer 2
Support
Emulsion Layer 2
Emulsion Layer 1
Interlayer
Overcoat The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer 1 Formulation | |
| Tabular grains [AgBr 4.0 μm ave. dia. × 0.125 μm thickness] | 12.9 Ag |
| Gelatin vehicle | 17.3 |
| 4-Hydroxy-6-methyl-1,3,3a,7-tetraazaindene | 2.1 g/Ag mole |
| Potassium nitrate | 1.8 |

-continued

| | Coverage (mg/dm$^2$) |
|---|---|
| Maleic acid hydrazide | 0.0022 |
| Sorbitol | 0.53 |
| Glycerin | 0.57 |
| Potassium bromide | 0.14 |
| Resorcinol | 0.44 |
| Bisvinylsulfonylmethane | 2% based on total gelatin in all layers on that side |
| Emulsion Layer 2 Formulation | |
| Tabular grains [AgBr 4.0 μm ave. dia. × 0.125 μm thickness] | 6.5 Ag |
| Gelatin vehicle | 8.6 |
| 5-Bromo-4-hydroxy-6-methyl-1,3,3a,7-tetraazaindene | 0.7 g/Ag mole |
| Microcrystalline Dye M-1 (shown below) | 1.08 |
| Potassium nitrate | 1.1 |
| Ammonium hexachloropalladate | 0.0013 |
| Maleic acid hydrazide | 0.0053 |
| Sorbitol | 0.32 |
| Glycerin | 0.35 |
| Potassium bromide | 0.083 |
| Resorcinol | 0.26 |
| Bisvinylsulfonylmethane | 2% based on total gelatin in all layers on that side |

M-1

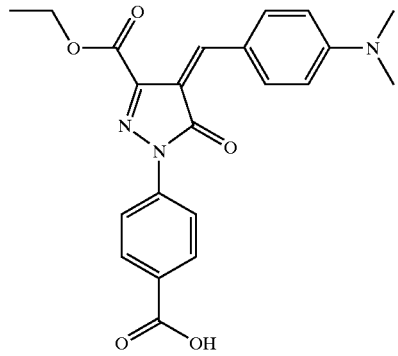

Radiographic Film B (Invention):

Radiographic Film B was a duplitized symmetric radiographic film with two different silver halide emulsion layers on each side of the support. The two emulsion layers contained tabular silver halide grains that were prepared and dispersed in oxidized gelatin that had-been added at multiple times before and/or during the nucleation and early growth of the silver bromide tabular grains dispersed therein. The tabular grains of the innermost silver halide emulsion layers had a mean aspect ratio of about 40 and the tabular grains of the outermost silver halide emulsion layers had a mean aspect ratio of about 32. The nucleation and early growth of the tabular grains: were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 nm was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

Film B had the following layer arrangement and formulations on the film support:

Overcoat
Interlayer
Emulsion Layer 1
Emulsion Layer 2
Support
Emulsion Layer 2
Emulsion Layer 1
Interlayer
Overcoat

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer 1 Formulation | |
| Tabular grains [AgBr 4.0 $\mu$m ave. dia. × 0.125 $\mu$m thickness] | 12.9 Ag |
| Oxidized gelatin vehicle | 2.2 |
| Non-oxidized gelatin vehicle | 15 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2.0% based on total gelatin on that side |
| Emulsion Layer 2 Formulation | |
| Tabular grains [AgBr 4.0 $\mu$m ave. dia. × 0.10 $\mu$m thickness] | 6.5 Ag |
| Oxidized gelatin vehicle | 1.1 |
| Non-oxidized gelatin vehicle | 7.5 |
| Microcrystalline Dye M-1 (shown above) | 1.08 |
| 5-Bromo-4-hydroxy-6-methyl-1,3,3a,7-tetraazaindene | 0.7 g/Ag mole |
| Potassium nitrate | 1.1 |
| Ammonium hexachloropalladate | 0.0013 |
| Maleic acid hydrazide | 0.0053 |
| Sorbitol | 0.32 |
| Glycerin | 0.35 |
| Potassium bromide | 0.083 |
| Resorcinol | 0.26 |
| Bisvinylsulfonylmethane | 2% based on total gelatin on that side |

Samples of the films were exposed through a graduated density step tablet to a MacBeth sensitometer for 1/50th second to a 500 watt General Electric DMX projector lamp calibrated to 2650° K, filtered with a Corning C4010 filter to simulate a green-emitting X-ray fluorescent intensifying screen.

The exposed film samples were processed using a commercially available KODAK RP X-OMAT® Film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

Fixing was carried out using KODAK RP X-OMAT® LO Fixer and Replenisher fixing composition (Eastman Kodak Company). The film samples were processed in each instance for less than 90 seconds (dry-to-dry).

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. log E curve was plotted for each radiographic film that was exposed and processed as noted above. Film speed was normalized by designating the film speed of Radiographic Film A as 400. A density vs. log E curve was generated for Radiographic Film B to determine its film speed relative to Radiographic Film A. Contrast (gamma) is the slope (derivative) of the density vs. log E sensitometric curve. The % crossover was measured using a procedure like that described above.

The following TABLE I shows the sensitometric data of Films A and B. The data show that Film B had increased photographic speed higher contrast, and $D_{max}$, and decreased fog.

TABLE I

| Film | Film Speed | Contrast | Fog | Crossover | $D_{max}$ |
|---|---|---|---|---|---|
| A (Control) | 400 | 2.6 | 0.24 | 8% | 3.1 |
| B (Invention) | 800 | 3.0 | 0.22 | 8% | 3.8 |

EXAMPLE 2

Radiographic Film C (Invention) was a duplitized symmetric radiographic film with two different silver halide emulsion layers on each side of the support. The two emulsion layers contained tabular silver halide grains that were prepared and dispersed in oxidized gelatin that had been added at multiple times before and/or during the nucleation and early growth of the silver bromide tabular grains dispersed therein. The tabular grains of the innermost silver halide emulsion layers had a mean aspect ratio of about 40 and the tabular grains of the outermost silver halide emulsion layers had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 nm was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

Film C had the following layer arrangement and formulations on the film support:

Overcoat
Interlayer
Emulsion Layer 1
Emulsion Layer 2
Support
Emulsion Layer 2
Emulsion Layer 1
Interlayer
Overcoat

| | Coverage (mg/dm$^2$) |
|---|---|
| Overcoat Formulation | |
| Gelatin vehicle | 2.3 |
| Methyl methacrylate matte beads | 0.53 |
| Carboxymethyl casein | 0.75 |
| Colloidal silica (LUDOX AM) | 1.1 |
| Polyacrylamide | 0.54 |
| Chrome alum | 0.025 |
| Resorcinol | 0.059 |
| Spermafol | 0.064 |
| ZONYL FSN surfactant | 0.15 |
| FC-124 surfactant | 0.34 |
| Interlayer Formulation | |
| Gelatin vehicle | 2.8 |
| AgI Lippmann emulsion | 0.011 |
| Carboxymethyl casein | 0.75 |
| Colloidal silica (LUDOX AM) | 0.57 |
| Poly(acrylamide-co-sodium-2-acrylamido-2-methylpropane-sulfonate | 0.24 |
| Polyacrylamide | 0.54 |
| Chrome alum | 0.025 |
| Resorcinol | 0.058 |
| Nitron | 0.038 |
| 4-OH, 6-methyl-1,3,3,3a-tetrazaindene | 0.46 |
| Emulsion Layer 1 Formulation | |
| Tabular grains [AgBr 4.0 $\mu$m ave. dia. × 0.1 $\mu$m thickness] | 15.1 Ag |
| Oxidized gelatin vehicle | 2.6 |
| Non-oxidized gelatin vehicle | 15.7 |
| 4-Hydroxy-6-methyl-1,3,3a,7-tetraazaindene | 2.1 g/Ag mole |
| Mercaptobenzotriazole | 0.00053 |
| Potassium bromide | 0.048 |
| Ammonium hexachloropalladate | 0.0022 |
| Maleic acid hydrazide | 0.0061 |
| Sorbitol | 0.24 |
| Glycerine | 0.30 |
| Resorcinol | 0.61 |
| Sodium disulfocathecol | 0.10 |
| Dow Corning SILICONE QCF2-5187 | 0.34 |
| Polyacrylamide | 0.61 |
| Dextran | 1.22 |
| Chrome alum | 0.037 |
| Bisvinylsulfonylmethane | 2.0% based on total gelatin on that side |
| Emulsion Layer 2 Formulation | |
| Tabular grains [AgBr 4.0 $\mu$m ave. dia. × 0.10 $\mu$m thickness] | 4.3 Ag |
| Oxidized gelatin vehicle | 0.74 |
| Non-oxidized gelatin vehicle | 8.0 |
| Microcrystalline Dye M-1 (shown above) | 1.08 |
| 2-Mercaptomethyl 4-hydroxy-6-methyl-1,3,3,3a-tetraazaindene | 0.7 g/Ag mole |
| Mercaptobenzotriazole | 0.00015 |
| Ammonium hexachloropalladate | 0.0013 |
| Maleic acid hydrazide | 0.0018 |

-continued

| | Coverage (mg/dm$^2$) |
|---|---|
| Sorbitol | 0.12 |
| Glycerine | 0.14 |
| Potassium bromide | 0.014 |
| Resorcinol | 0.17 |
| Sodium disulfocathecol | 0.052 |
| Carboxymethyl casein | 0.16 |
| Polyacrylamide | 0.29 |
| Dextran | 0.57 |
| Chrome alum | 0.017 |
| TRITON ® X200E surfactant | 0.088 |
| Olin 10G surfactant | 0.44 |
| Versa TL 502 thickener | 0.24 |
| Bisvinylsulfonylmethane | 2% based on total gelatin on that side |

A sample of Film C was exposed through a graduated density step tablet to a MacBeth sensitometer for 1/50th second to a 500 watt General Electric DMX projector lamp calibrated to 2650° K, filtered with a Corning C4010 filter to simulate a green-emitting X-ray fluorescent intensifying screen.

The exposed film sample was processed as described in Example 1 and optical densities were likewise determined. Film speeds were normalized by designating Radiographic Film A as having a film speed of 400. A density vs. log E curve was generated for Film C to determine its film speed relative to Film A. Contrast (gamma) is the slope (derivative) of the density vs. log E sensitometric curve. The % crossover was measured using a procedure like that described above.

The following TABLE II shows the sensitometric data of Films A and C. The data show that Film C had increased photographic speed, higher contrast, and $D_{max}$, and decreased fog.

TABLE II

| Film | Film Speed | Contrast | Fog | Crossover | $D_{max}$ |
|---|---|---|---|---|---|
| A (Control) | 400 | 2.6 | 0.24 | 8% | 3.1 |
| C (Invention) | 800 | 3.2 | 0.22 | 8% | 4.1 |

EXAMPLE 3

Radiographic Film D (Invention) was a duplitized, symmetric radiographic film with the same silver halide emulsion layer on each side of the support. Unlike Films B and C, Film D contained no crossover control agent. The two emulsion layers contained tabular silver halide grains that were prepared and dispersed in oxidized gelatin that had been added at multiple times before and/or during the nucleation and early growth of the silver bromide tabular grains dispersed therein. The tabular grains of each silver halide emulsion layer had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 ni was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

Film D had the following layer arrangement and formulations on the film support:

Overcoat
Interlayer
Emulsion Layer
Support
Emulsion Layer
Interlayer
Overcoat

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Tabular grains [AgBr 4.0 $\mu$m ave. dia. × 0.10 $\mu$m thickness] | 19.4 Ag |
| Oxidized gelatin vehicle | 3.3 |
| Non-oxidized gelatin vehicle | 23.0 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2.0% based on total gelatin on each side |

The cassettes used for imaging contained two of the following screens, one on each side of the noted radiographic films:

Fluorescent intensifying screen "X" was prepared using known procedures and components to have a terbium activated gadolinium oxysulfide phosphor (median particle size of 7.8 to 8 $\mu$m) dispersed in a Permuthane™ polyurethane binder on a white-pigmented poly(ethylene terephthalate) film support. The total phosphor coverage was 4.83 g/dm$^2$ and the phosphor to binder weight ratio was 19:1.

Fluorescent intensifying screens "Y" were prepared using known procedures and components and included two different ("asymmetric") screens. Each of the screens comprised a terbium activated gadolinium oxysulfide phosphor layer on a white-pigmented poly(ethylene terephthalate) film support. The phosphor (median particle size of 7.8 to 8 $\mu$m) was dispersed in a Permuthane™ polyurethane binder. The total phosphor coverage in the screen used on the frontside ("exposed side") was 4.83 g/dm$^2$ and the total phosphor coverage on the screen used on the backside was 13.5 g/dm$^2$. The phosphor to binder weight ratio in each screen was 19:1.

Samples of the films in the imaging assemblies were exposed using an inverse square X-ray sensitometer (device that makes exceedingly reproducible X-ray exposures). A lead screw moved the detector between exposures. By use of the inverse square law, distances were selected that produced exposures that differed by 0.100 log E. The length of the exposures was constant. This instrument provided sensitometry that gives the response of the detector to an imagewise exposure where all of the image is exposed for the same length of time, but the intensity is changed due to the anatomy transmitting more or less of the X-radiation flux.

The exposed film samples were processed as described in Example 1, and optical densities were likewise determined. The characteristic density vs. log E curve was plotted for each radiographic film that was exposed and processed as noted above. Contrast (gamma) is the slope (derivative) of the density vs. logE sensitometric curve.

The following TABLE III shows sensitometric data for the use of Film D.

TABLE III

| Film | Tabular grain size ($\mu$m) | Screen | Contrast | Fog ($D_{min}$) | Film Speed |
|---|---|---|---|---|---|
| D (Invention) | 4.0 × 0.10 | X | 3.2 | 0.25 | 1000 |
| D (Invention) | 4.0 × 0.10 | Y | 3.2 | 0.25 | 1000 |

The invention has been described in detail with particular reference to preferred embodiments thereof, but it will be understood that variations and modifications can be effected within the spirit and scope of the invention.

What is claimed is:

1. A radiographic silver halide film having a film speed of at least 700, and comprising a support that has first and second major surfaces, said radiographic silver halide film having disposed on said first major support surface, two or more hydrophilic colloid layers including at least one silver halide emulsion layer, and having on said second major support surface, two or more hydrophilic colloid layers including at least one silver halide emulsion layer, each of said silver halide emulsion layers comprising tabular silver halide grains that have the same or different composition and said tabular silver halide grains are dispersed in a hydrophilic polymeric vehicle mixture comprising at least 0.05% of oxidized gelatin, based on the total dry weight of said hydrophilic polymeric vehicle mixture.

2. The film of claim 1 that is symmetric.

3. The film of claim 1 having disposed on said first major support surface, two or more hydrophilic colloid layers including first and second silver halide emulsion layers, and having on said second major support surface, two or more hydrophilic colloid layers including third and fourth silver halide emulsion layers, said first and third silver halide emulsion layers being the outermost emulsion layers on their respective sides of said support, each of said first, second, third, and fourth silver halide emulsion layers comprising tabular silver halide grains that have the same or different composition, an aspect ratio of at least 15, an average grain diameter of at least 3.0 $\mu$m, and comprise at least 50 mol % bromide and up to 5 mol % iodide, both based on total silver in said grains, said second and fourth silver halide emulsion layers comprising a crossover control agent sufficient to reduce crossover to less than 15%.

4. The film of claim 1 wherein said tabular silver halide grains in said silver halide emulsion layers are composed of at least 90 mol % bromide and up to 1 mol % iodide, both based on total silver in the emulsion layer.

5. The film of claim 1 wherein all of said tabular grains in said silver halide emulsion layers are green-sensitized tabular silver halide grains.

6. The film of claim 1 wherein said tabular silver halide grains in said silver halide emulsion layers independently have an aspect ratio of from about 25 to about 45, an average grain diameter of at least 3.5 $\mu$m, and an average thickness of from about 0.06 to about 0.16 $\mu$m.

7. The film of claim 3 wherein said tabular silver halide grains in said first, second, third, and fourth silver halide emulsion layers independently have an aspect ratio of from about 25 to about 45, an average grain diameter of at least 3.5 $\mu$m, and an average thickness of from about 0.06 to about 0.16 $\mu$m.

8. The film of claim 3 wherein said first, second, third, and fourth silver halide emulsion layers independently comprise from about 1 to about 15% deionized oxidized gelatin, based on total hydrophilic polymer vehicle mixture dry weight.

9. The film of claim 8 wherein said first, second, third, and fourth silver halide emulsion layers independently comprise from about 1 to about 15% deionized oxidized gelatin, based on total hydrophilic polymer vehicle mixture dry weight.

10. The film of claim 3 wherein the dry, unprocessed thickness ratio of said first silver halide emulsion layer to that of said second silver halide emulsion layer is from about 3:1 to about 1:1, and the dry, unprocessed thickness ratio of said third silver halide emulsion layer to that of said fourth silver halide emulsion layer is independently from about 3:1 to about 1:1.

11. The film of claim 3 wherein the molar ratio of silver in said first silver halide emulsion layer to that of said second silver halide emulsion layer is greater than 1:1, and the molar ratio of silver in said third silver halide emulsion layer to that of said fourth silver halide emulsion layer is independently greater than 1:1.

12. The film of claim 1 wherein the amount polymer vehicle on each side of said support is from about 20 to about 40 mg/dm$^2$ and the level of silver on each side of said support is from about 10 to about 25 mg/dm$^2$.

13. The film of claim 3 wherein said crossover control agent is present in an amount sufficient to reduce crossover to less than 12%.

14. The film of claim 3 wherein said crossover control agent is a particulate merocyanine or oxonol dye.

15. The film of claim 3 wherein said crossover control agent is present each of said second and fourth silver halide emulsion layers independently in an amount of from about 0.75 to about 1.5 mg/dm$^2$.

16. A symmetric radiographic silver halide film having a film speed of at least 750 and comprising a support that has first and second major surfaces, said radiographic silver halide film having disposed on said first major support surface, two or more hydrophilic colloid layers including first and second silver halide emulsion layers, and having on said second major support surface, two or more hydrophilic colloid layers including third and fourth silver halide emulsion layers, said first and third silver halide emulsion layers being the outermost emulsion layers on their respective sides of said support, each of said first, second, third, and fourth silver halide emulsion layers independently comprising tabular silver halide grains that have the same chemical composition, an aspect ratio of from about 38 to about 45, an average grain diameter of at least 3.5 $\mu$m, and an average thickness of from about 0.08 to about 0.14 $\mu$m, and comprise at least 95 mol % bromide and up to 1 mol % iodide, both based on total silver in said grains, each of said second and fourth silver halide emulsion layers comprising a particulate magenta oxonol dye as a crossover control agent present in an amount of from about 1 to about 1.3 mg/dm$^2$ that is sufficient to reduce crossover to less than 12% and that is decolorized during development within 90 seconds, said film further comprising a protective overcoat on both sides of said support disposed over all of said hydrophilic colloid layers, wherein said tabular silver halide grains in said second and fourth silver halide emulsion layers are dispersed in a hydrophilic polymeric vehicle mixture comprising from about 0.05 to about 15% of deionized oxidized gelatin, based on the total dry weight of said hydrophilic polymeric vehicle mixture, wherein the dry, unprocessed thickness ratio of said first silver halide emulsion layer to that of said second silver halide emulsion layer is from about 3:1 to about 1:1, and the dry, unprocessed thickness ratio of said third silver halide emulsion layer to that of said fourth silver halide emulsion layer is independently from about 3:1 to about 1:1, and wherein the molar ratio of silver in said first silver halide emulsion layer to that of said second silver halide emulsion layer is from about 1.5:1 to about 3:1, and the molar ratio of silver in said third silver halide emulsion layer to that of said fourth silver halide emulsion layer is independently from about 1.5:1 to about 3:1.

17. A radiographic imaging assembly comprising the radiographic silver halide film of claim 1 that is arranged in association with one or more fluorescent intensifying screens.

18. A radiographic imaging assembly comprising the radiographic silver halide film of claim 16 that is arranged in association with two fluorescent intensifying screens, one on either side thereof.

19. A radiographic imaging assembly comprising the radiographic silver halide film of claim 3 that is arranged in association with two fluorescent intensifying screens, one on either side thereof.

20. A method of providing a black-and-white image comprising exposing the radiographic silver halide film of claim 1 and processing it, sequentially, with a black-and-white developing composition and a fixing composition.

21. The method of claim 20 comprising using the black-and-white image for a medical diagnosis.

* * * * *